US007005588B2

(12) United States Patent
Pihlaja

(10) Patent No.: US 7,005,588 B2
(45) Date of Patent: Feb. 28, 2006

(54) KEYBOARD AND A METHOD FOR MANUFACTURING IT

(75) Inventor: Pekka Pihlaja, Helsinki (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/865,187

(22) Filed: Jun. 10, 2004

(65) Prior Publication Data

US 2004/0256203 A1 Dec. 23, 2004

(30) Foreign Application Priority Data

Jun. 13, 2003 (FI) ..... 20030893

(51) Int. Cl.
*H01H 9/26* (2006.01)

(52) U.S. Cl. ..... 200/5 A; 200/343

(58) Field of Classification Search ..... 200/341–344, 200/512–520, 5 A, 5 R; 400/491.2–496, 400/491.1, 490, 472, 473
See application file for complete search history.

(56) References Cited

U.S. PATENT DOCUMENTS

| | | | | | |
|---|---|---|---|---|---|
| 3,294,927 | A | * | 12/1966 | Hill | 200/5 R |
| 3,627,935 | A | * | 12/1971 | Spievak | 200/5 R |
| 3,707,611 | A | | 12/1972 | Twyford | |
| 3,800,104 | A | * | 3/1974 | Lien et al. | 200/5 A |
| 3,909,564 | A | * | 9/1975 | Scheingold et al. | 200/5 E |
| 3,982,081 | A | * | 9/1976 | Demler, Jr. | 200/5 R |
| 4,029,916 | A | * | 6/1977 | Chu | 200/5 A |
| 4,194,105 | A | * | 3/1980 | Hodges | 200/517 |
| 4,271,333 | A | * | 6/1981 | Adams et al. | 379/368 |
| 4,315,114 | A | * | 2/1982 | Monti, Jr. | 200/5 A |
| 4,338,502 | A | * | 7/1982 | Hashimoto et al. | 200/512 |
| 4,354,077 | A | * | 10/1982 | McMains et al. | 200/314 |
| 4,440,515 | A | * | 4/1984 | Nassimbene | 400/479 |
| 4,453,063 | A | * | 6/1984 | Wanatowicz et al. | 200/344 |
| 4,469,461 | A | | 9/1984 | Landa | |
| 4,480,937 | A | | 11/1984 | Eckhardt | |
| 4,864,085 | A | * | 9/1989 | Hanajima et al. | 200/5 A |
| 5,075,524 | A | * | 12/1991 | Klatt et al. | 200/446 |
| 5,934,454 | A | * | 8/1999 | Burleson et al. | 200/343 |
| 6,005,209 | A | * | 12/1999 | Burleson et al. | 200/343 |
| 6,027,267 | A | | 2/2000 | Yokobori | |
| 6,570,111 | B1 | * | 5/2003 | Nakagawa et al. | 200/343 |
| 6,828,520 | B1 | * | 12/2004 | Galli | 200/406 |

FOREIGN PATENT DOCUMENTS

| | | | |
|---|---|---|---|
| EP | 1 031 596 AA1 | | 8/2000 |
| GB | 2087154 A | * | 5/1982 |
| GB | 2234113 A | * | 1/1991 |
| JP | 03084820 A | * | 4/1991 |
| SE | 522 110 | | 1/2004 |

* cited by examiner

*Primary Examiner*—Michael Friedhofer
*Assistant Examiner*—Lisa Klaus
(74) *Attorney, Agent, or Firm*—Holingsworth & Funk, LLC

(57) ABSTRACT

A keyboard comprising at least one flap forming a key, the flap being pressed against a contact point when depressed from above, and rising back after the depressing. The flap is attached by its one end to the frame sheet of the keyboard in such a way that this structure forms the hinge of the key. There is at least one buckling member in connection with the flap, and the flap is formed rigid. The keyboard may be formed in such a way, for example, that a keyboard frame sheet is formed, the flap forming the key is cut partially off the keyboard frame sheet, a buckling member is formed in connection with the flap, and the flap is lifted upwards from the surface of the frame sheet.

19 Claims, 3 Drawing Sheets

KEYBOARD AND A METHOD FOR MANUFACTURING IT

BACKGROUND OF THE INVENTION

The invention relates to a keyboard comprising at least one flap forming a key, and a contact point, the flap being pressed against the contact point when depressed from above, and rising back after the depressing.

Further, the invention relates to a method for forming a keyboard.

U.S. Pat. No. 4,480,937 discloses a keyboard having a metal sheet provided with leaf springs. The end of a leaf spring is flexible and is depressed with a plunger at the tip of which there is typically a key top. When the plunger is depressed, the contact cantilevers formed on the sides of the leaf spring get into contact with a contact surface, and after the depressing the leaf spring raises the plunger into the upper position. Such a keyboard structure is complex and takes a lot of space, and in addition, it is rather difficult to manufacture.

U.S. Pat. No. 4,160,886 discloses a keyboard formed in a plastic sheet in such a way that the plastic sheet comprises key projections extending upwards and a protuberance extending downwards towards a contact surface. The keys are partially cut off the plastic sheet in such a way that they are attached to the plastic sheet only by one edge. A separate dome spring is arranged below each key, whereby the dome spring buckles downwards when a key is depressed, contacting the contact surface, and after the depressing, the dome spring returns the key into the upper position. A mask provided with openings for the keys is arranged upon the plastic sheet. The structure of the keyboard is complex and contains several layers. Therefore, the keyboard is rather difficult to manufacture. Further, the space available for the key graphics on the upper surface of the keys is relatively small.

BRIEF DESCRIPTION OF THE INVENTION

An object of the present invention is to provide a keyboard of a new type which is improved compared with prior art, and a method for manufacturing it.

The keyboard according to the invention is characterized in that the flap is attached by one of its edges to the frame sheet of the keyboard, whereby this edge forms the hinge of the key; that there is at least one buckling member in connection with the flap; and that the flap is formed rigid, whereby the flap clicks to touch the contact point after the flap is depressed with such a great force that the bending threshold of the buckling member is exceeded.

Further, the method according to the invention is characterized by forming a frame sheet for the keyboard, cutting a flap to the keyboard frame sheet in such a way that the flap is attached to the keyboard frame sheet by one of its edges; bending the flap upwards from the surface of the frame sheet of the keyboard and forming a buckling member in connection with the flap.

An essential idea of the invention is that the keyboard has a flap that is attached to the frame sheet of the keyboard by one of its edges, whereby this edge forms a hinge around which the flap turns. Further, the structure of the flap is formed as a spring; in other words, the flap can be pressed downwards or lifted upwards, and after the pressing or lifting, the flap returns to its normal position. There is a buckling member associated with the flap, whereby, when the flap is depressed, the buckling member buckles, clicking, when it exceeds the bending threshold. A key is formed in such a way that the flap touches the contact point when the buckling member has been depressed so much that it buckles over the bending threshold. Further, the flap is formed rigid, whereby no separate key top is needed in the key.

An advantage of the invention is that the keyboard structure is simple and thus also reliable and easy to manufacture. Further, the user receives clear tactile feedback from the keyboard. The keyboard structure is thin and simple, because separate rigid key tops are not needed. Further, owing to the hinge in a key, the course of movement of the key is very accurate. The flap forming the key can be made rather big in size, in which case it has a lot of space for the key graphics. The key can be lifted upwards from its free end, but it still stays in its place, and owing to its structure the lifted key returns to its original position. All in all, the keys of the keyboard are firm and stay securely in desired places, whereby the appearance and ergonomics of the keyboard remain good.

BRIEF DESCRIPTION OF THE FIGURES

The invention will be explained in more detail in connection with the attached drawings, of which

For the sake of clarity, the invention is shown simplified in the figures. Similar parts are denoted with the same reference numerals.

DETAILED DESCRIPTION OF THE INVENTION

Figure 1:
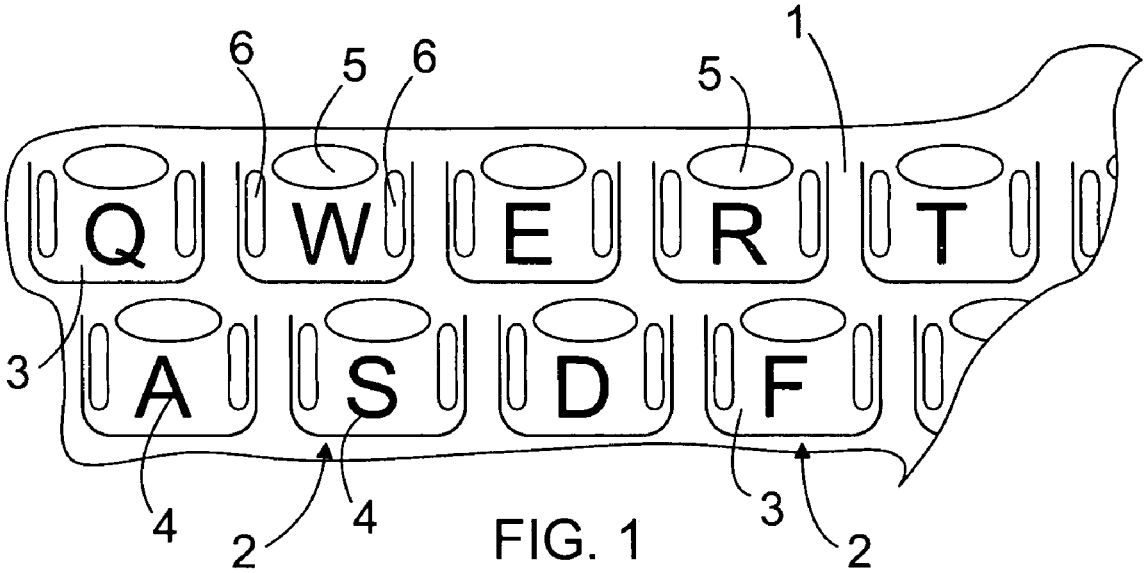
FIG. 1 shows a schematic top view of a part of a keyboard.
Figure 2:
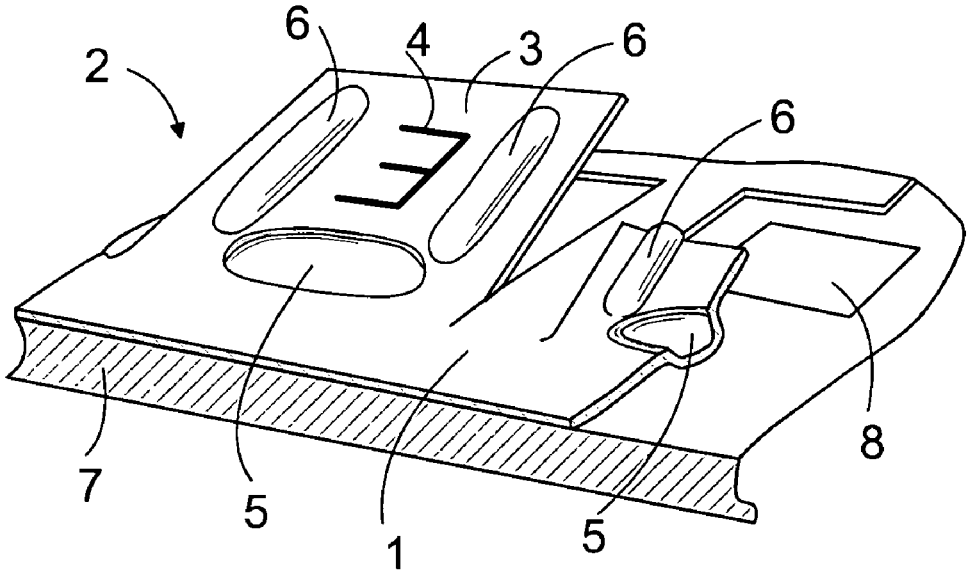
FIG. 2 shows a schematic perspective view and partial section of keys.

FIG. 1 shows a keyboard frame sheet 1, which comprises keys 2. The structure of the keys is also illustrated in FIG. 2. For the sake of clarity, the key 2 on the right side is shown cut and in cross-section in FIG. 2.

The key 2 comprises a flap 3. The upper surface of the flap 3 indicates key graphics 4, i.e. a number, letter and/or other character or sign entering of which is provided by depressing the key.

The keyboard is formed by forming first a sheet of a size of the whole keyboard or at least several keys 2. The sheet can be a steel sheet, for example. The steel sheet can be of spring steel, for example. The thickness of the steel sheet can be, for instance, 0.05 to 0.30 mm. For example, the thickness of the steel sheet can be 0.15 mm. The sheet can be, instead of steel, of some other sufficiently elastic and durable material, such as rubber or other suitable material. A flap 3 is cut to the sheet, and a shallow and flat dent 5 is formed at the root of each flap 3. Further, protuberances 6 may be formed in the flap 3, for instance at its edges. Furthermore, the flap 3 is bent upwards from the surface of the sheet. The flap 3 is thus formed in such a way that it is cut off the sheet by three of its sides, being attached to the sheet by one side. When depressed, the flap 3 turns around its one side functioning as a hinge. The key 2 can be formed in one working phase by punching the key 2 out of the sheet. In such a case, the flap 3 is thus cut off the sheet by three sides with a pressing tool, and simultaneously a dent 5 and protuberances 6 are formed in the key and the key 2 is bent into the position where the free end of the flap 3 is upwards.

The keyboard thus formed is arranged upon the device frame 7. The keyboard may be a separate keyboard that is connected to the device, such as a computer, with a wire or a wireless connection. In such a case, the device frame 7, in which the frame sheet 1 of the keyboard is arranged, is a support frame. On the other hand, the keyboard may be arranged directly in connection with the frame of the device, such as a mobile phone or other mobile station, a portable computer, a pocket calculator, or the like.

The dent 5 forms a buckling member in connection with the flap 3. When the key is depressed, it bends from its root by buckling. Thus, when the flap 3 exceeds the bending threshold, it buckles downwards, whereby the user receives clear tactile effect. Simultaneously, a clicking sound is heard. The key is formed in such a way that the flap 3 touches a contact point 8 formed upon the device frame 7 when the flap 3 bends over the bending threshold. Since the structure of the key 2 is rigid, the flap 3 in FIG. 2 rises into the indicated position when the downward-pressing force directed at the key stops. The contact point 8 may be a contact surface, contact area, contact point or contact pin.

That side of the flap 3 which is attached to the keyboard frame sheet 1 forms a hinge around which the flap 3 can turn. Thus, the movement of the flap 3 is restricted and controlled. The flap 3 can be lifted upwards from its free end, but owing to the structure of the key 2, the flap 3 also clicks downwards into its correct position. Thus, the keys formed of the flap 3 remain at the desired height and the keyboard is aesthetically and ergonomically successful.

The dent 5 at the base of the flap 3 thus causes the flap 3 to buckle downwards when depressed. The dent 5 is shaped elliptical, but if desired, it can be of another shape. The dent 5 is nearly as wide as the flap 3. An essential feature of the dent 5 is that it is arranged at the hinge point, whereby the edges of the flap 3 at the hinge point are higher than its middle point.

The protuberances 6 are form reinforcements that stiffen the flap. The elongated protuberances 6 shown in the figure reinforce particularly the side edges of the flap 3, but if desired, they can be arranged at another point in the flap 3 and/or shaped differently. The flaps 3 are so rigid that the keyboard does not necessarily need a separate rigid key top. However, for aesthetic reasons and due to the dust or other protection, the keys can be provided with key tops, if desired. In addition to or instead of using protuberances 6, the flaps 3 can be formed sufficiently rigid by, for example, adding a reinforcement plate to the flap 3 or by forming the flap 3 of so thick and rigid material that the flap 3 does not essentially bend. The flap 3 must be rigid in order to achieve contact only after buckling; in other words the contact and buckling must be functionally associated with each other. If the flap were not sufficiently rigid, it might bend to touch the contact surface before buckling, which would result in insecure key function. Further, if the flap 3 were not rigid, a rigid key top would be needed on top of it, which would add to the height of the keyboard and make the keyboard more complex.

The keyboard frame plate 1 may function as a ground plane. When the flap 3 is depressed, galvanic contact is established at the contact point 8, on the basis of which contact information on a particular key being depressed is transmitted to the device used. The contact points 8 are arranged to form a contact matrix upon the device frame 7 in such a way that there is a contact point 8 at each key point. Detection of key depressing or processing and forwarding of this information are not described in greater detail here, because these aspects are obvious to a person skilled in the art.

Figure 3:
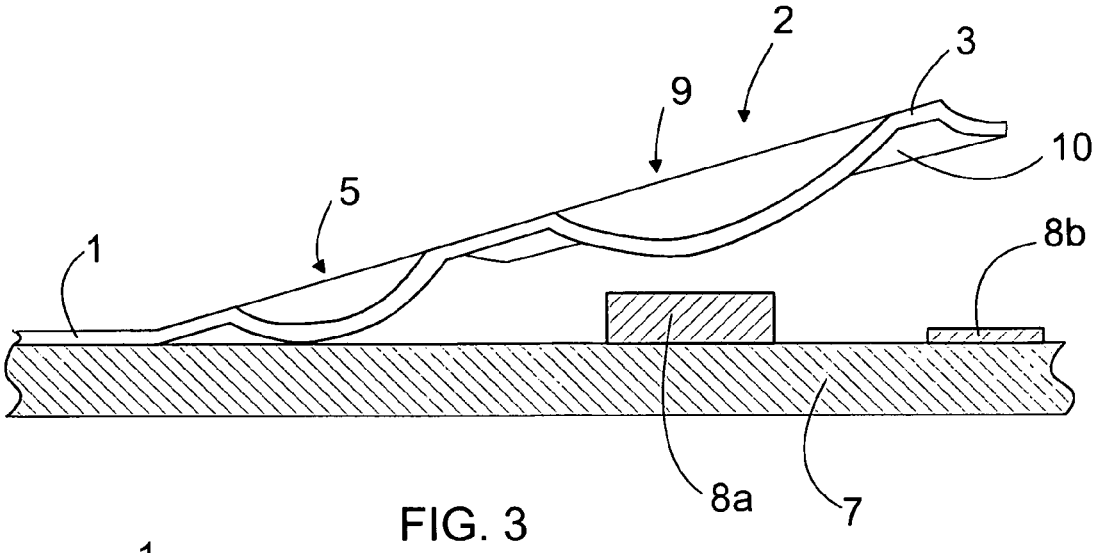
FIG. 3 shows a schematic side view and cross-section of a second embodiment of a key.
Figure 4:
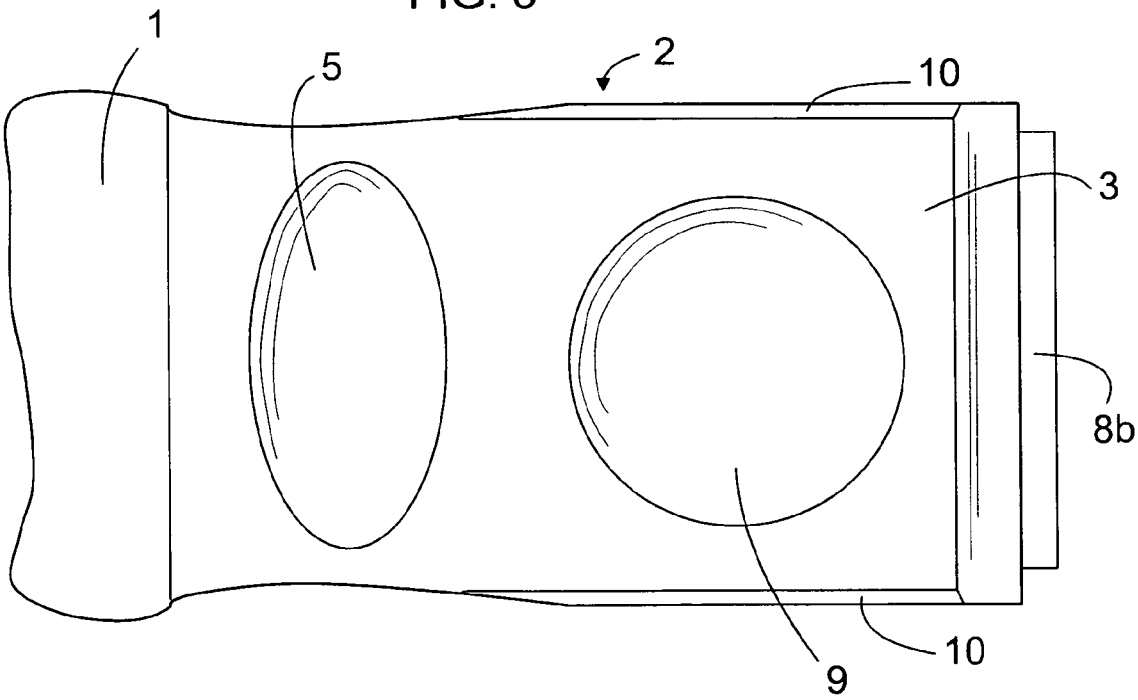
FIG. 4 shows a schematic top view of the key according to FIG. 3.

FIGS. 3 and 4 show a solution where the key 2 comprises two buckling members. The first buckling member is a dent 5, as in the embodiment of FIG. 2. The second buckling member is formed by a second dent 9, which is formed in the flap 3 close to its front edge. The first and the second buckling members are formed in such a way that when the flap 3 is pressed downwards, the first buckling member buckles first, the member being formed of the first dent 5, as mentioned. Thus, the flap 3 touches the first contact point 8*a*. When the key is depressed further, the second buckling member, i.e. the second dent 9, buckles, whereby the flap 3 touches the second contact point 8*b*. Thus, two different functions can be achieved with one key, depending on with how great a force the key is depressed. With regard to elevation, the first contact point 8*a* and the second contact point 8*b* can also be arranged at different heights, as shown in FIG. 3. In such a case, the structure can take into account that the flap 3 touches both contact points 8*a*, 8*b* only when desired. Naturally, arranging the contact points 8*a* and 8*b* at particular heights is affected by the structure of the flap 3, for example the dimensions of the dent 9. After the buckling of the first buckling member, the bottom of the second dent 9 is supported against the first contact point 8*a*. Thus, the first contact point 8*a* functions as a support point, with which the function of the second buckling member can be made reliable and accurate.

The key can also be formed in such a way that it has no dent 5, whereby it comprises only a buckling member formed by the dent 9. In such a case, the root of the flap 3 functions as an ordinary hinge, i.e. without buckling function. Buckling takes place only for the part of the dent 9, whereby only the buckling of the dent 9 provides contact between the flap tip and the contact point below it. Thus, the hinge forming the root part of the flap 3 is prestressed in such a way that the flap 3 is in a raised position. Also in such a case, there may be a support point that is in a raised position below the dent 9, against which support point the key is first depressed, and when the key is depressed further, buckling and after that contact with the contact point take place. The flap can be prestressed also in such a way that it is unloaded, i.e. in the rest position, against a support point, for example a pin. In such a case, the movement of the flap is restricted to that taking place in connection with the buckling member.

In the key shown in FIGS. 3 and 4, the edges 10 of the flap 3 are bent downwards. The bent edges 10 increase the rigidity of the flap 3, functioning thus as reinforcement members in a similar way as the protuberances 6 in FIGS. 1 and 2.

Also what is called a four-way scroller can be formed of the keys 2. Thus, such a structure is formed of the keys 2 in which a flap 3 is formed in four different directions. If, in such a case, two buckling members are formed in the key 2, a key having two different functions can be formed in each direction of the four-way scroller. Thus, depressing the key in such a way that the first buckling member buckles provides a function, for instance a movement in a particular direction. When the key is depressed with a greater force, whereby also the second buckling member buckles, for example a second function can be provided, in which case, for example, a movement is directed in the depressed direction at a higher speed.

If the distance between the keys is short, the problem is that when a key is depressed, also the adjacent key may be unintentionally depressed. For instance with stepped-up keyboards, i.e. keyboards where the keys are in successive rows in such a way that the base sheet slants upwards, there is a risk that when a key is depressed, the key in the next highest or lowest row is unintentionally depressed as well. This problem can be solved with the solution shown in FIGS. 5 and 6.

Figure 5:
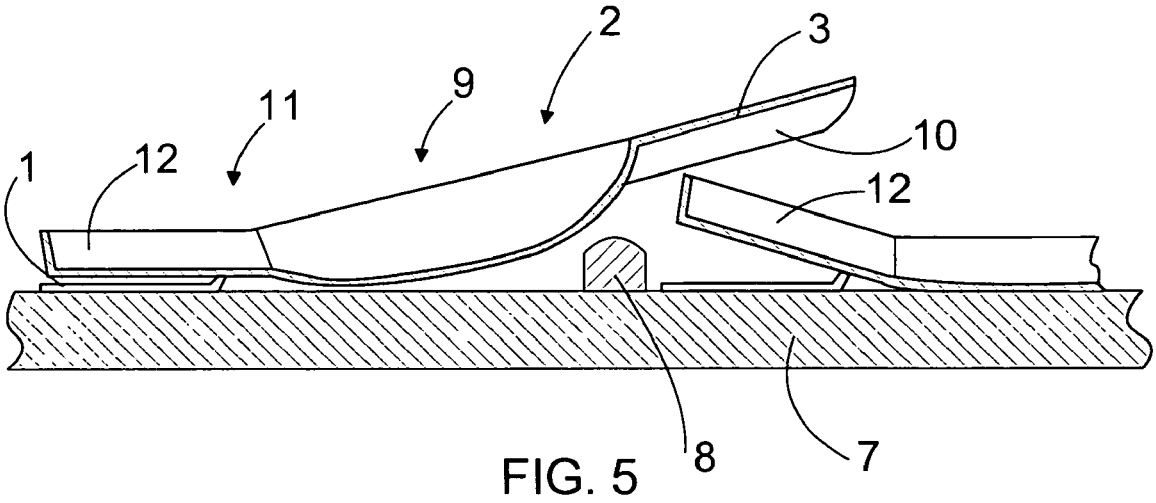
FIG. 5 shows a schematic side view and cross-section of a third embodiment of a key.
Figure 6:
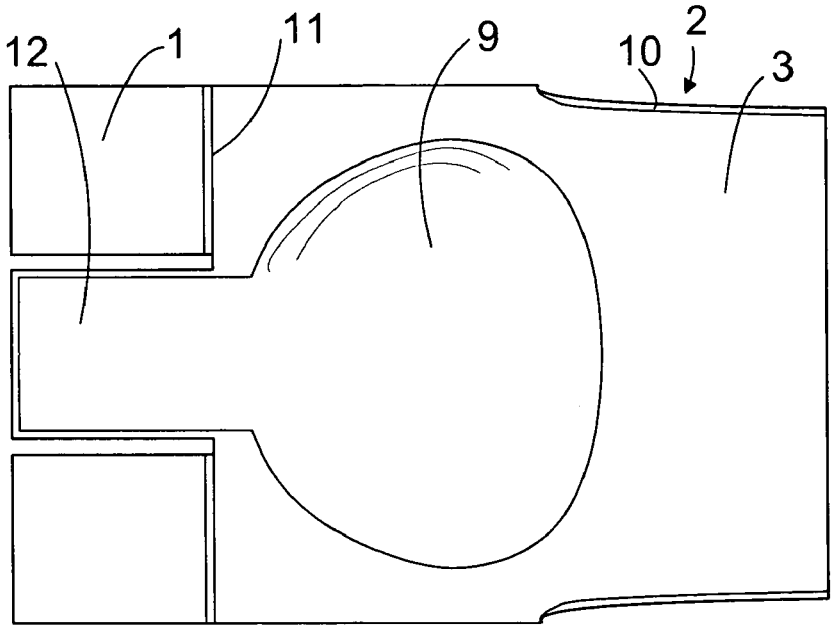
FIG. 6 shows a schematic top view of the key according to FIG. 5.

In the solution of FIGS. 5 and 6, there is a bend 11 functioning as a hinge at the root of the flap 3. The dent 9 is arranged to begin at a distance from the bend 11. The key 2 comprises a nose 12 that is formed, relative to the hinge point, on the side opposite to that of the flap 3. The nose 12 is formed in the key 2 in such a way that when the flap 3 is depressed, the nose 12 rises up on the opposite side of the hinge. The nose 12 is arranged to extend below the flap 3 of the key 2 in the next row.

In FIG. 5, the flap 3 of the key 2 on the right side is depressed, whereby the nose 12 of the key has risen up. The nose prevents the flap 3 of the key on the left side from being pressed downwards in FIG. 5. Further, the depressed flap 3 depresses the nose 12 of the key 2 in the next row below. Thus, the flap of the key in the next row cannot be depressed. Further, the nose 12 prevents the free end of the flap 3 from being lifted upwards.

The corner between the flap 3 and the nose 12 must thus be rigid; in other words, the corner between the flap 3 and the nose 12 stays substantially the same during use. Further, the nose 12 must be rigid, whereby it can keep the flap in the adjacent row up. In FIGS. 5 and 6, the nose 12 is formed rigid by bending its edges upwards. When the flap 3 is depressed, the upward-rising nose can, if desired, be also formed with a sheet or corresponding structure to be positioned on top of the key 2, which structure comprises a part following the surface of the flap 3, a rigid nose 12 and a part forming the corner between the mentioned parts and remaining rigid. Such a structure can also be arranged for instance in a key in which the buckling member is at the point of the key hinge. Further, a structure comprising a nose that rises up when the flap is depressed can be formed in a key in which there is a hinge at the root of the flap but not necessarily any buckling member at all.

The drawings and the related description are only intended to illustrate the idea of the invention. The details of the invention can vary within the scope of the claims. Thus, openings may be cut to the flaps 3 through which the key graphics can be illuminated from below the frame sheet 1 of the keyboard. Further, also other keyboard illumination solutions may be applied in connection with a keyboard according to the invention. The key graphics 4 can be formed in the flap 3 either by painting or with a sticker, or in another appropriate manner. Further, for instance a transparent plastic film can be arranged on top of the keys. Still further, a plastic film arranged on top of the keys may indicate the key graphics, in which case the plastic film needs not be transparent.

Instead of the dents 5 and 9, the buckling member may be formed in another appropriate manner. For instance, instead of the dent 5, a structure having an upward-shaped ridge as the buckling member may be used at the root of the flap 3. The dent 5 is, however, easy to form with respect to the keyboard structure, and at the same time, the keys can be shaped as desired. Further, the buckling member forming the dent 5 functions accurately and reliably with respect to the buckling. Instead of the dent 9 formed in the flap 3 close to its front edge, a dome directed upwards can be used as the buckling member at the corresponding point. In order to provide buckling, it must be possible to flatten such a dome with a finger, so the dome must be sufficiently large. The flaps may be bent upwards, as shown in FIGS. 2 and 3. The flaps 3 can, however, be formed such that they are in the direction of the frame sheet 1. Thus, the frame sheet 1 is arranged at a distance from the frame 7, whereby the flap 3 is depressed downwards from the plane of the frame sheet 1, and after the depressing, the flap returns to the height of the frame sheet 1. The keyboard frame sheet 1 does not necessarily have to be continuous, but the keys 2 may be separate and arranged adjacently. It is easy to arrange the keyboard of the invention in the cover of a device, because the key mechanics themselves guarantee that the keys stay at correct level when not depressed. Thus, no cover is needed on top of the keyboard to guarantee that the keys stay at correct level.

What is claimed is:

1. A keyboard comprising a frame sheet, at least one flap forming a key, and a contact point, the flap being pressed against the contact point when depressed from above, and rising back after the depressing, wherein the flap is attached by one of its edges to the frame sheet of the keyboard, whereby this edge forms the hinge of the key; there is at least one buckling member in connection with the flap at that edge of the flap which is attached to the keyboard frame sheet; and the flap is formed rigid, whereby the flap clicks to touch the contact point after the flap is depressed with such a great force that the bending threshold of the buckling member is exceeded.

2. A keyboard according to claim 1, wherein several flaps forming a key are attached to the keyboard frame sheet.

3. A keyboard according to claim 2, wherein all keys of the keyboard are attached to one keyboard frame sheet.

4. A keyboard according to claim 1, wherein the buckling member is formed by a dent.

5. A keyboard according to claim 1, wherein there are at least two buckling members in connection with the flap.

6. A keyboard according to claim 5, wherein a first buckling member is formed by a first dent formed at that edge of the flap which is attached to the keyboard frame sheet, and a second buckling member is formed by a second dent formed close to the front edge of the flap.

7. A keyboard according to claim 1, wherein at least one reinforcement member is formed in the flap.

8. A keyboard according to claim 1, wherein the key comprises a nose in the opposite direction from the hinge relative to the flap, the nose rising up when the key is depressed.

9. A keyboard according to claim 8, wherein the nose is formed to be of the same structure as the flap by shaping the sheet that forms the structure.

10. A keyboard according to claim 1, wherein the keyboard is a computer keyboard.

11. A keyboard according to claim 1, wherein the keyboard is a mobile station keyboard.

12. A method for forming a keyboard, the method comprising forming a frame sheet for the keyboard, cutting a flap to the keyboard frame sheet in such a way that the flap is attached to the keyboard frame sheet by one of its edges; bending the flap upwards from the surface of the frame sheet of the keyboard and forming a buckling member in connection with the flap at that edge of the flap which is attached to the keyboard frame sheet.

13. A method according to claim 12, comprising implementing the cutting and bending of the flap and forming of the buckling member substantially simultaneously.

14. A method according to claim 12, comprising the buckling member being formed by forming a dent.

15. A method according to claim 14, comprising implementing the cutting and bending of the flap and forming of the dent in it substantially simultaneously.

16. A method according to claim 12, wherein at least one reinforcing protuberance is formed in the flap.

17. A method according to claim 16, comprising implementing the cutting and bending of the flap and forming a buckling member and a protuberance in it substantially simultaneously.

18. A method according to claim 12, wherein the keyboard frame sheet is formed in such a way that several keys are formed in it.

19. A method according to claim 18, wherein the keyboard frame sheet is formed in such a way that its size is sufficient to comprise all keys of the keyboard.

* * * * *